United States Patent [19]

Marshall

[11] 4,084,635

[45] Apr. 18, 1978

[54] HEAT RECOVERY AND HEAT DISTRIBUTING APPARATUS

[75] Inventor: Hugh G. Marshall, Como, Canada

[73] Assignee: Midland-Ross Corporation, Cleveland, Ohio

[21] Appl. No.: 715,396

[22] Filed: Aug. 18, 1976

[51] Int. Cl.[2] ..... F28D 15/00

[52] U.S. Cl. ..... 165/107; 165/165; 165/DIG. 12

[58] Field of Search ..... 165/165, 107, DIG. 12; 34/86

[56] References Cited

U.S. PATENT DOCUMENTS

| | | | |
|---|---|---|---|
| 3,712,026 | 1/1973 | Griffiths et al. | 165/107 |
| 3,995,688 | 12/1976 | Darm | 165/165 |

FOREIGN PATENT DOCUMENTS

| | | | |
|---|---|---|---|
| 2,240,088 | 2/1974 | Germany | 165/165 |

*Primary Examiner*—Charles J. Myhre
*Assistant Examiner*—Margaret A. LaTulip
*Attorney, Agent, or Firm*—Woodrow W. Portz

[57] ABSTRACT

Disclosed is apparatus and a system thereof for reclaiming heat through the transfer of heat from normally waste hot gases to a liquid medium, usually water, and redistributing the heat by way of the liquid medium to spatially distant heat exchangers. The heat exchangers employed for initial heat reclamation are of a design uniquely adapted to avoid plugging under freezing conditions.

12 Claims, 10 Drawing Figures

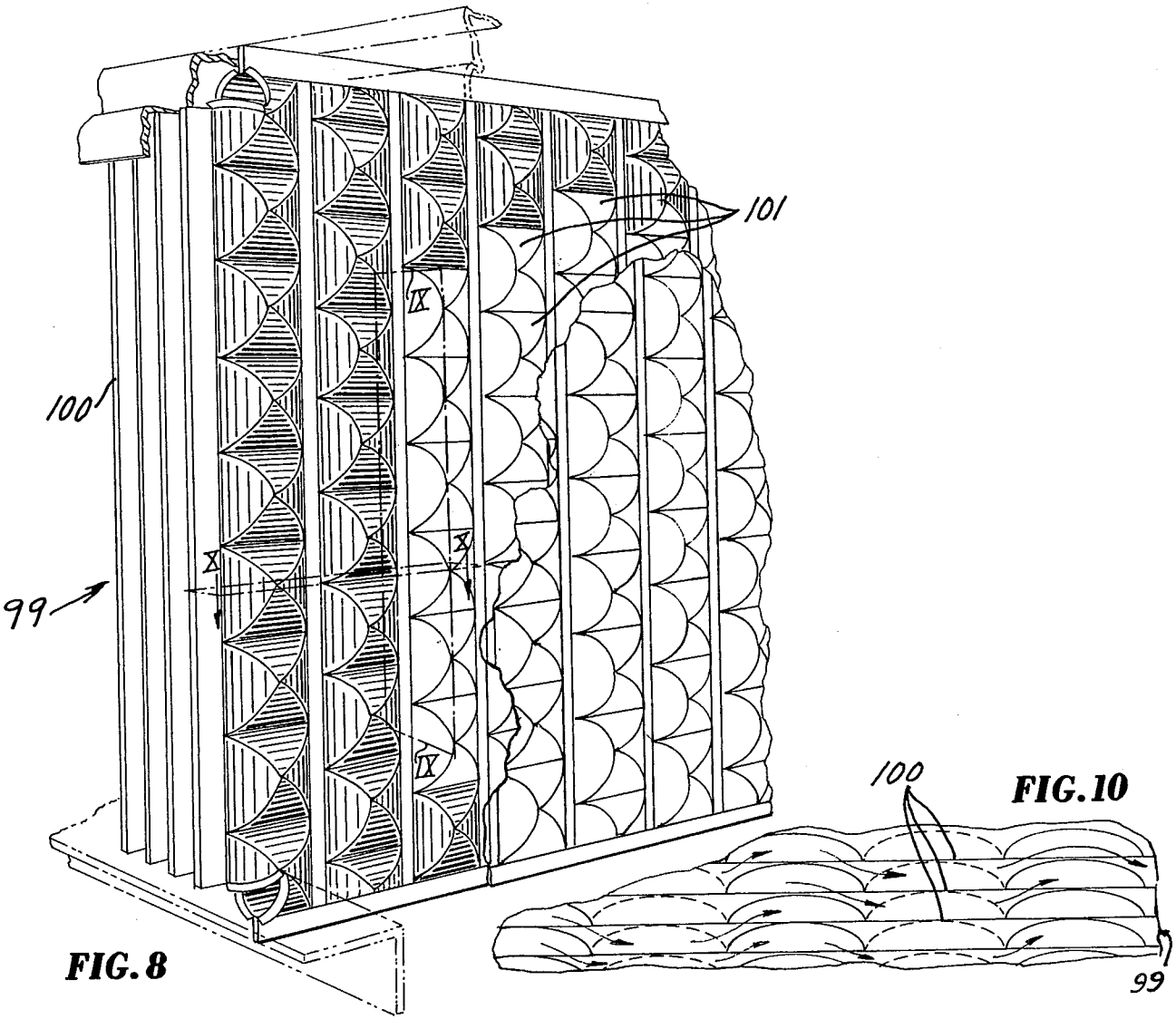
FIG. 8
FIG. 10
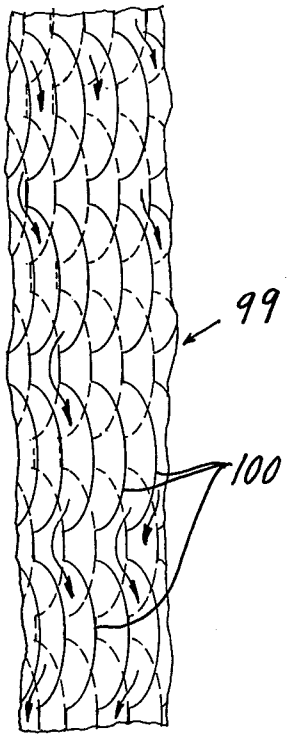
FIG. 9

HEAT RECOVERY AND HEAT DISTRIBUTING APPARATUS

BACKGROUND OF THE INVENTION

The present invention arises in the operation of typical large paper manufacturing facilities located in cold climate areas such as Canada, Scandanavia, and Siberia. A larger paper plant has pulping, digesting, pulp dryer, and paper machine facilities which are frequently housed in separate buildings at some distance apart. There are such sources of waste heat as heated air collected over the paper machine driers, exhaust steam from the steam heated rolls of the paper machine, heated air from the pulp drier, exhaust steam from the pulp drier, heat from vacuum pumps serving driers, heated exhaust gases discharged by vacuum pumps, steam exhaust from thermomechanical pulping equipment, and exhaust from the digesters. Thus, there are many sources of waste heat invested in gaseous media available for distribution to heat consuming locations frequently at a distance. However, transporting heat by gaseous media is expensive because of the large bulky duct work and associated insulating materials needed to channel gaseous material in frigid weather. It is now appreciated that liquid carriers require much less expensive duct systems in constructing the rambling heat distribution systems necessary.

In a typical construction of gas-to-liquid heat exchangers, liquid is passed through a large plurality of parallel tubes within a chamber through which the gas is passed into contact with the outer surfaces of the tubes. If in any emergency the gas channel of an endothermic is subjected to ambient temperatures of the winter season, such a heat exchanger is subject to freeze-up which damages the tubes. Freeze-ups are particularly a hazard of the heat exchangers which are intended to heat the ambient air.

It is an essential object of the invention to provide suitable apparatus for reclaiming heat from waste industrial plant gases and transferring the heat by liquid medium to locations in dispersed relation with the sources of waste heat, and especially to provide gas-to-liquid heat exchanger apparatus resistant to freeze-ups and, if frozen, designed to remain partly open.

Another object is to provide liquid-to-gas heat exchangers which function to heat ambient air in cold climates and are capable of sustaining freeze-ups without damage.

A further object is to provide a system of reclaiming and collecting heat energy, and redistributing the energy to dispersed heat consumption locations through the use of freeze-damage immune heat exchangers.

SUMMARY OF THE INVENTION

The invention is embodied in a heat reclaiming system for use in frigid winter conditions which may involve dispersed heat collecting and heat distributing locations wherein a first gas-to-liquid heat exchanger or a first plurality thereof are in remote connection with a second heat exchanger or a plurality thereof. The first heat exchanger, or each of the plurality thereof has an endothermic liquid conducting portion with upper inflow means and lower outflow means. The second heat exchanger or each of the plurality thereof, has an exothermic liquid conducting portion having inflow means and outflow means connected with the outflow means and inflow means of the first heat exchanger, respectively.

Either or both liquid conducting portions comprise in each case an assembly of vertically extending horizontally-spaced sheets or plates coextending horizontally and vertically in parallel vertical planes. In one form, the sheets are corrugated with the corrugations occurring progressively in the horizontal direction with the sinuosity of adjacent sheets in similar parallel relationship. As another sheet arrangement instead of corrugated sheets, the sheets may be stamped to a grid pattern of vertical rows of concavo-convex protuberances or bosses reminiscent of egg crate dividers. The adjacent vertical rows are preferably staggered by one-half the width of a single boss. The sheets are arranged in parallel order to dispose the protruding sides of the bosses of one sheet toward and into the cupped regions defined by the concave sides of the bosses of the adjacent sheet. The edges of the grid-type sheets are joined in the same manner to provide vertical passageways separated from horizontal passages.

The two types of sheets first mentioned, i.e., the corrugated and the grid plate designs, have complementary back-to-back surfaces such that a plurality thereof would in an unassembled condition for packaging, nest together as laminae, so that when spaced in respective assemblies for operation, all portions of opposed back-to-back surfaces are uniformly spaced. Other modes of forming the sheets with indented or embossed non-planate or concavo-convex portions by which opposed sheets cooperate to induce turbulence and a minimum of laminar flow in a fluid flowing therebetween and to achieve effective heat exchanging between the fluids at opposite sides of a sheet.

BRIEF DESCRIPTION OF THE DRAWING

FIG. 8 is a fragmentary perspective view of a portion of a heat exchanger provided with modified grid or waffle plate construction which may be substituted in place of corrugated sheets shown in FIG. 3.

FIG. 9 is a fragmentary schematic vertical cross section of an assembly of sheets in accordance with the construction shown in FIG. 8 as they would appear when substituted in the assembly of FIG. 3.

FIG. 10 is a fragmentary schematic horizontal cross sectional view of the sheets as viewed in reference to line X—X of FIG. 9 and plane X—X of FIG. 8.

DESCRIPTION OF PREFERRED EMBODIMENTS

Figure 1:
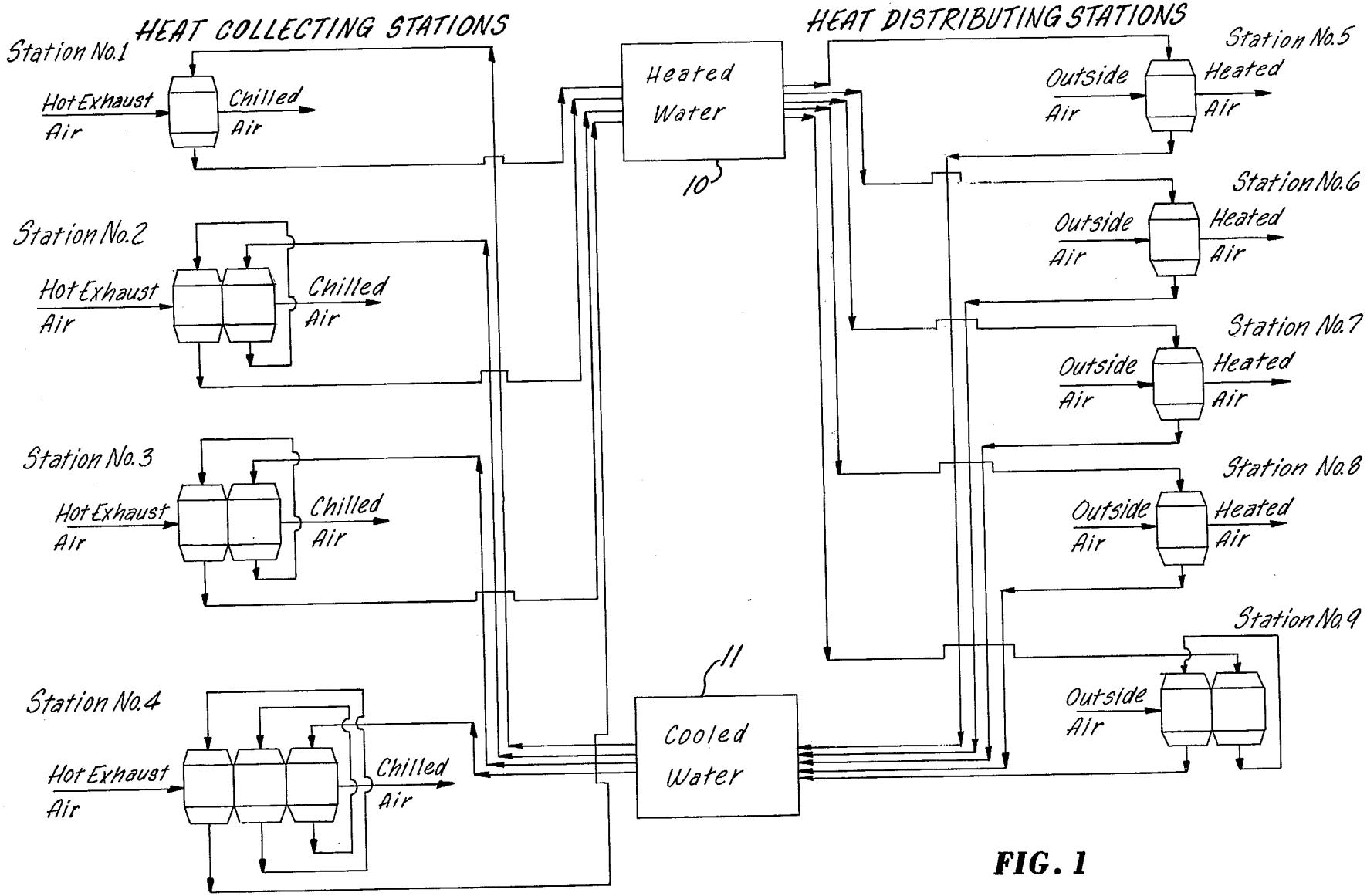
FIG. 1 is a diagram showing a fluid heat transfer system comprising a plurality of heat-acquiring liquid-heating stations in liquid recycling relation with a plurality of heat-distributing liquid-cooling stations.

FIG. 1 is a diagram illustrating broad scale utilization of the invention in accordance to a concept wherein a plurality of heat collecting stations 1, 2, 3 and 4 receive waste heat into a liquid carrier which is caused to transport the heat to a common collector or a reservoir 10 and be distributed to heat distributing stations 5, 6, 7, 8 and 9. After heat is extracted from the liquid carrier within the heat distributing stations, the liquid carrier is returned to the heat collecting stations through a duct system which may include a common reservoir or collector 11 for distribution of the cooled water or other liquid medium to the heat extracting stations.

Figure 2:
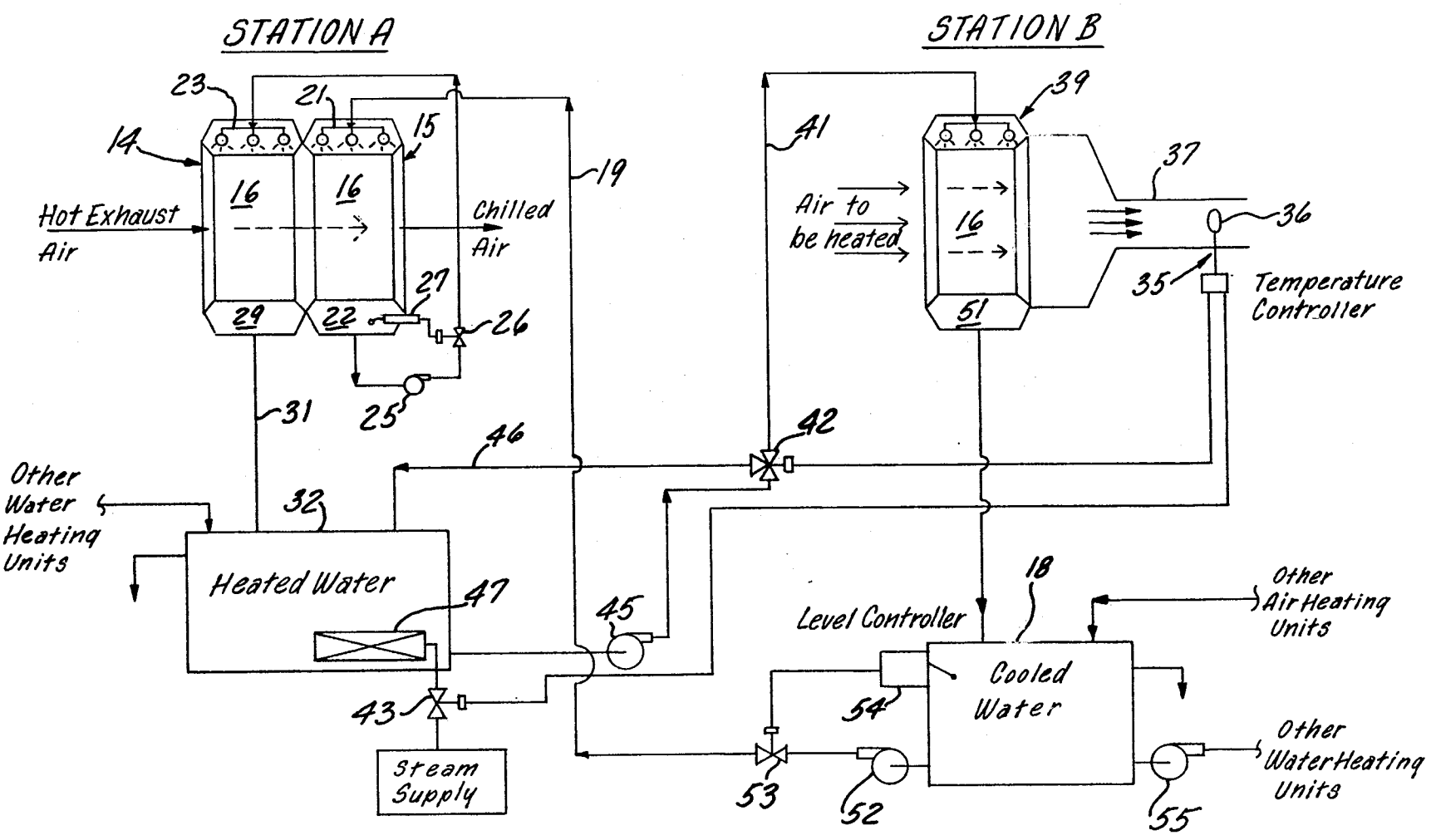
FIG. 2 is a diagram illustrating a single heat-acquiring liquid-heating station in liquid recycling relation with a heat-distributing liquid-cooling station with certain required items of control apparatus omitted in FIG. 1.

FIG. 2 illustrates in small scale the concept of FIG. 1 for the purpose of indicating some of the auxiliary control equipment necessary in operating the simple system of FIG. 2 as well as the more complex system of FIG. 1. For example, station A typifies stations 1, 2, 3, or 4 of FIG. 1 while station B is exemplary of stations 5, 6, 7, 8 or 9 of FIG. 1. As shown, station A is equipped with two heat exchanging units 14, 15 equipped with a heat exchanging sheet assembly such as the assembly 16 of FIG. 3. The system of FIG. 2 is operated by passing water from the cooled water reservoir 18 to unit 15 through line 19 to shower heads 21 located above assembly 16. Initially warmed water from sump 22 of unit 15 is passed through the shower heads 23 of the unit 14 through the assembly 16 thereof to affect a generally countercurrent flow of water through the two units with respect to hot exhaust air passing progressively through the two units as shown by the arrows. To prevent the circulating pump 25 from running dry and becoming damaged, the discharge therefrom is controlled by a valve 26 responsive to a float operated controller 27 to maintain a desired medium level of liquid in this sump 22. Final discharge of heated liquid from station A occurs from the sump 29 of unit 14 through line 31 into the heated water reservoir 32. Heated water is conducted in principle from a reservoir 32 to heat distributing stations such as station B.

Station B is illustrated as apparatus which discharges air at a controlled temperature monitored by a controller 35 having a temperature sensing antenna 36 in the outlet 37 for air or other gas heated by the heat exchange unit 39. Obviously, regulation of the temperature of the output gas through duct 37 makes necessary control of the heat input of unit 39 by heated water supplied to the unit through line 41. This is done by controlling the volume of the water passing through line 41 and the temperature thereof. As shown, the controller 35 is connected with a proportioning valve 42 and a steam flow-regulating valve 43. Assuming that the antenna 36 registers a temperature above the control temperature to which it is adjusted, the proportioning valve 42 is signaled to return heated water supplied thereto from the reservoir 32 by the pump 45 back to the reservoir through line 46. Simultaneously, the valve 43 is signaled to reduce the flow of steam, if any, to a heater 47 within the reservoir. If steam is not being supplied, the controller acts on the valve to increase the recirculation of water to the reservoir through line 46. Conversely, if antenna 36 senses the temperature to be below the control temperature, the controller 35 acts on valve 42 to decrease the bypassing of water through line 46 and increase the flow through supply line 41. Simultaneously, the steam control valve 43 is incrementally opened to heat the water proceeding to station B to bring about such heat exchange within the unit 39 as to obtain heated gas passing the antenna 36 at the desired control temperature. The cooled water reservoir 18 receives water from the sump 51 of unit 39 which has given up heat to the air to be heated passing through unit 39. The cooled water is returned by a pump 52 to the unit 15 of station A for commencing another cycle of circulation. The output of the pump 52 is controlled by a valve 53 in turn controlled by a float operated level controller 54 in order that a medium level may be maintained in the reservoir to avert damage to the pump from dry operation. As indicated, the reservoir 18 may receive cooled water from the air heating units of stations other than that of station B, and discharge water to the water heating units of stations other than station A, for example, through the pump 55.

Figure 3:
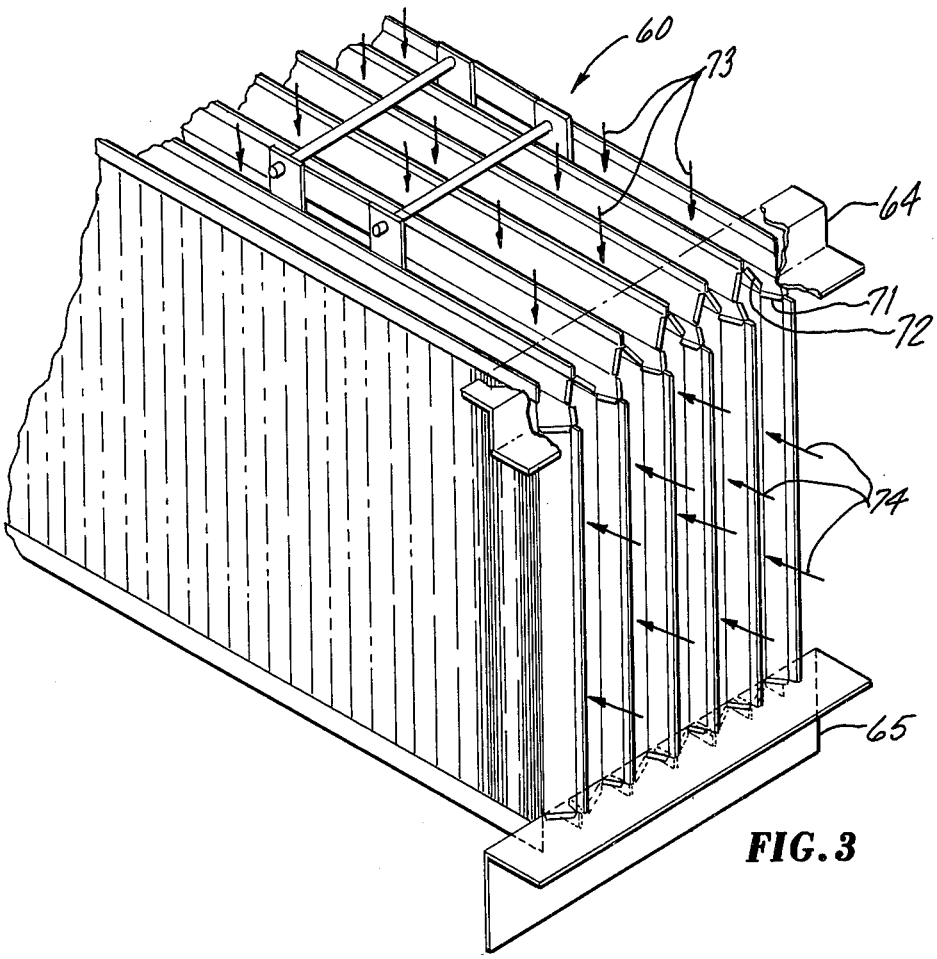
FIG. 3 is a fragmentary perspective view illustrating primarily an assembly of corrugated sheets having the function of placing two fluids in indirect heat exchanging relationship.
Figure 4:
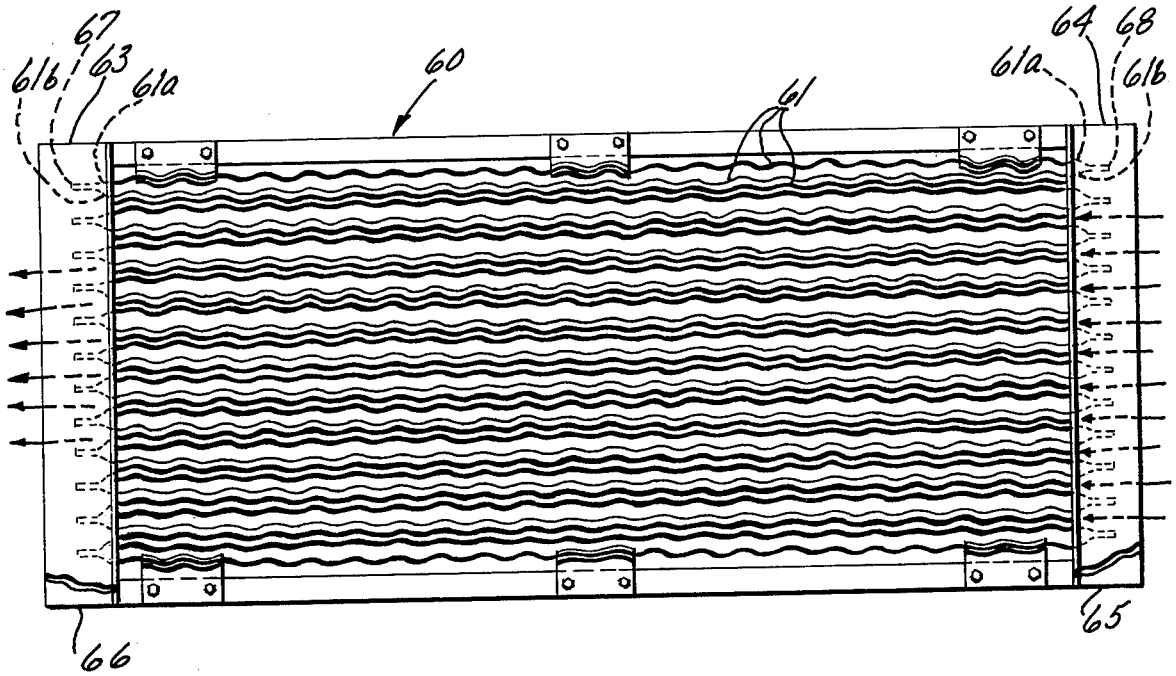
FIG. 4 is a fragmentary top plan view of a heat exchanger including the assembly of sheets shown in FIG. 3.

FIGS. 3, 4, 5, 6 and 7 illustrate various features of a corrugated plate assembly 60 which may be considered as one form of the assembly 16 of units 14, 15 and 39. Viewed in plan, FIG. 4 illustrates that the assembly is comprised to a large degree of corrugated sheets 61 of which the sinuousity of corrugation extends in the horizontal direction. Within an operable assembly, the sheets 61 are mounted in spaced parallel vertically extending planes and are rectangular except for corner portions receiving angle pieces 63, 64, 65 and 66. The sheets have lateral side edges at opposite lateral extremities which are joined together in horizontally successive pairs. For example, sheets **61*a* and 61*b* are joined in a common edge at their lateral extremities in joints 67 and 68**. The next horizontally occurring pair of sheets are joined in a similar manner and so on with other pairs of sheets. At the top and bottom edges of the sheets, one sheet of each pair of laterally joined sheets is joined to the mutually facing sheet from the next adjacent pair of laterally joined sheets.

In this manner, each pair of laterally joined sheets forms a passageway for vertical movement of liquids. Each pair of sheets having their top and bottom edges joined forms a passageway for horizontal movement of air or other gas through the assembly of sheets and disposes the horizontal passageways in alternate relation with the vertical passageways. The sheets of each assembly 60 are indented at the corners as illustrated in FIG. 3 to receive the angle pieces 63 to 66 which then function as closure means at the four corners of the assembly connecting with the sheets in sealed relation, especially at the tabs 71 and 72 to close off intercommunication of the vertical passageways with the horizontal passageways. Arrows 73 indicate the direction of movement of a liquid into the vertical passageways; arrows 74 indicate movement of a gaseous material into the horizontal passageways. The angle pieces 63 to 66 are portions of a supporting frame for the assembly 60 comprising also other frame members 76, 77, 78, 79 and various other members visible in the figures.

Figure 5:
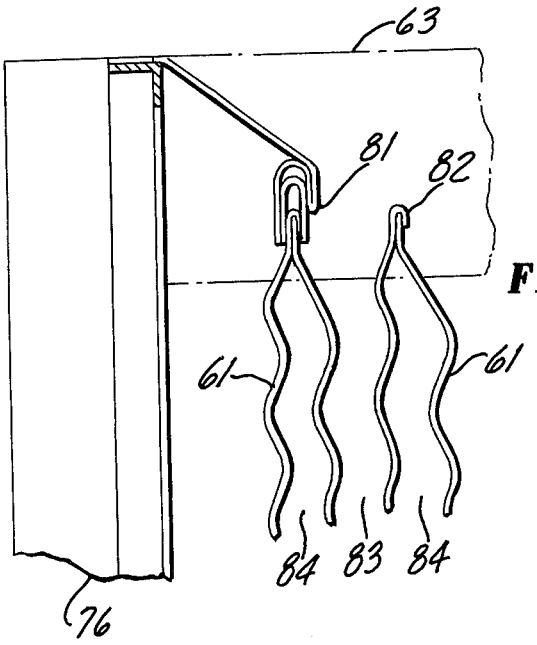
FIG. 5 is a fragmentary top plan view of a portion of the heat exchanger of FIG. 4 showing detailed construction thereof.

FIG. 5 is a view in plan illustrating the manner of constructing lateral edge joints 81, 82. The resulting joined pairs of sheets forms a horizontal passageway 83 and vertical passageways 84, 85.

Figure 6:
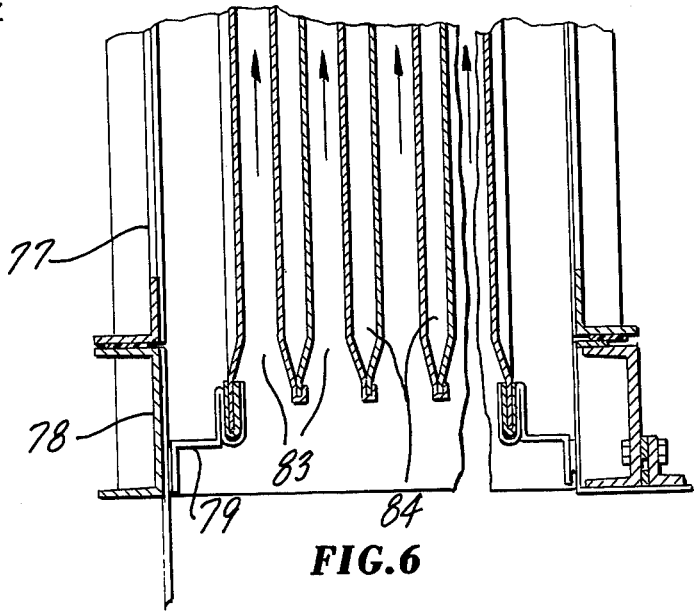
FIG. 6 is a fragmentary elevation in section illustrating detailed construction of the heat exchanger of FIGS. 3, 4 and 5.

FIG. 6 illustrates the manner of forming the bottom and top joints (the top joints not shown) of horizontally successive pairs of sheets which define the vertical passageways 83 and the horizontal passageways 84.

Figure 7:
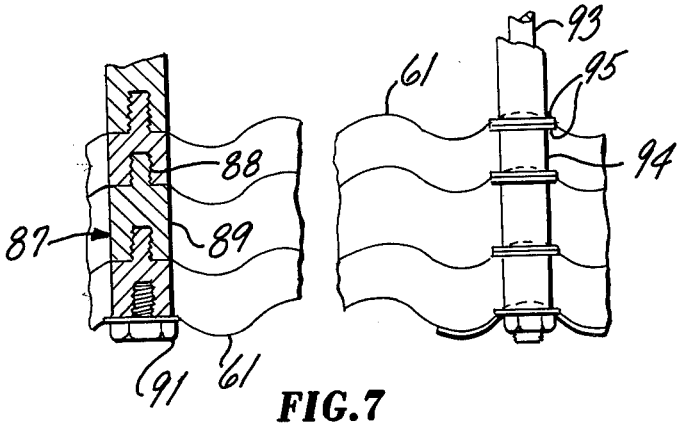
FIG. 7 is a fragmentary horizontally shortened plan view in section of portions of the sheet assembly of FIG. 3 showing the mode of spacing the corrugated sheets.

FIG. 7 illustrates two arrangements for spacing the sheets 61. At the left of the figure the spacers consist of elements 87, each of which has a threaded stud portion 88 and an interiorly threaded body portion 89 providing a threaded bore for receiving the stud portion of the next adjacent element 87. A series of such spacers terminates in an ordinary cap screw 91 at one end and an ordinary nut at the other end. The spacer assembly shown at the right of FIG. 7 consists of an elongate rod 93 threaded at both ends and a series of cylindrical spacers 94 having washers 95 at opposite ends for sandwiching apertured portions of the sheets 61 therebetween when spacing the sheets as shown.

As shown in FIGS. 8, 9 and 10, the invention is not restricted to sheets of corrugated configuration. Shown therein are sheets 100 of a heat exchanging unit 99 of which substantially their entire area is formed with concavo-convex bosses 101 which, as shown, protrude in one direction from a general plane of the sheet. As shown in FIGS. 9 and 10, the sheets are similarly shaped so that all areas of each sheet are uniformly spaced with horizontally adjacent areas of the next adjacent sheet. The bosses 101 are of sufficient concavity or convexity that the convex surface of one boss extends beyond the general plane of the next adjacent sheet into the concave region formed by the boss of the next horizontally adjacent boss. As shown, one vertical row of bosses is staggered with repsect to the next horizontally adjacent row approximately one-half of a boss width. While FIG. 8 shows the adjacent rows staggered or offset in a vertical direction, the bosses may be formed in rows staggered in the horizontal direction, or with non-staggered rows aligned at 45° or other angle between the vertical and the horizontal while maintaining passage of liquid in a generally vertical direction and the passage of gaseous material in a horizontal direction.

As indicated hereinbefore, the heat collecting stations of FIG. 1 (also station A of FIG. 2) may use the same type of liquid conducting unit (see FIGS. 3 and 4) as the heat distributing stations of FIG. 1 (also station B of FIG. 2). In achieving freeze damage immunity, the heat exchangers of this invention are not adapted to contain liquid standing at any appreciable level therein in either the vertical or the horizontal passageways because of the thin walls provided by the sheets 61 through which one fluid is in heat exchange relation with another fluid.

The liquid heat carrier circulating through the systems of e.g., of FIGS. 1 and 2, traverses the vertical passageways of the heat exchange units 16, 60, 99 without establishing a liquid head or level within the units. This condition is obtained through provision of adequate sumps in the heat exchangers, such as sumps 29, 22, 51, and drainage to reservoirs. Also the apparatus for supplying liquid to the exchangers such as pumps 45, 52 are selected with capacities which do not flood the vertical passageways of the heat exchangers. Heat exchanging is deemed most efficient in the free-flow by gravity of the liquid through the tortuous vertical passageways provided by the closely spaced sheets without any establishment of a liquid head within the vertical passageways.

The heat exchanger units are purposely designed and intended for sustaining freeze-ups. Emergency conditions in a paper mill may result in drastic reduction and the temperature of the air passing horizontally through the heat collecting stations, or in the temperature of heat-carrying water descending through the heat distributing stations of FIG. 1. In frigid weather, progressive freezing in units, such as 16, 60, 99 begins at the side of the unit first entered by freezing air. As ice forms in the vertical passageways, the sheets yield slightly in a lateral direction but are neither damaged nor permanently deformed. Ordinarily, complete freeze-ups are not sustained since the vertical passageways remain partially open along the side of the exchanger further away from the entering side for the frigid air. As the horizontally moving air or gas, or the vertically moving liquid, warms again sufficiently, the frozen liquid quickly melts and the vertical passageways rapidly open for free flow.

What is claimed is:

1. Freeze-resistant heat-recovery apparatus comprising:

an aqueous medium;

a first, or gas-to-liquid, waste-heat reclaiming, heat exchanger having an endothermic liquid-conducting portion providing an upper inflow means and a lower outflow means;

a second, or liquid-to-fluid heat-distributing heat exchanger in remote relation with the first heat exchanger having an exothermic liquid-conducting portion provided with an inflow means and an outflow means; and first duct means connecting the inflow means of the first heat exchanger to the outflow means of the second heat exchanger, and second duct means connecting the outflow means of the first heat exchanger to the inflow of the second heat exchanger;

said liquid-conducting portion of said first heat exchanger comprising:

an assembly of vertically-extending horizontally-spaced generally-rectangular sheets arranged in generally parallel planes of which each is indented or embossed substantially over its entire area to provide concavo-convex non-planate portions in said sheets in assembled closely-spaced relationship for causing any fluid passing therebetween to be subjected to turbulence;

said sheets having lateral side edges at opposite lateral extremities, and top and bottom edges;

said sheets being joined together in horizontally successive pairs of which each successive pair of sheets has its top edges joined and its bottom edges joined to provide a horizontal passageway;

the side edges of adjacent mutually-facing sheets adjacent pairs of top-and-bottom joined sheets being joined at opposite lateral extremities to provide a vertical passageway between each of adjacent pairs of top-and-bottom joined sheets;

closure means at four corners of the assembly connecting with the sheets to close off intercommunication of the vertical passageways with the horizontal passageways;

said inflow means of the first heat exchanger comprising shower means supported over the upper entrances of all of said vertical passageways;

liquid supply means and regulating means therefor limiting the supply of said liquid to said shower means to a rate of avoiding any standing liquid head in said vertical passageways;

header means for enclosing the entrances of said horizontal passageways at one side of said assembly; and means for supplying air or other gas to said header means.

2. The apparatus of claim 1 wherein:

each of said sheets is indented or embossed to form said concavo-convex indented portions in identical pattern on all of said sheets;

said sheets in assembled relationship causing the convex surfaces of said portions of one sheet to protrude toward or into corresponding concave surfaces of the next adjacent sheet while maintaining substantially uniform spacing between all portions of opposing sheets.

3. Apparatus of claim 1 wherein:

the sheets are corrugated with the direction of sinuosity of corrugation extending in a common direction.

4. The apparatus of claim 3 wherein:

the direction of sinuosity of corrugation is horizontal.

5. The apparatus of claim 1 wherein:

said inflow means of each of said liquid-conducting portion is in substantially vertically upward relation with its said corresponding outflow means.

6. The apparatus of claim 1 comprising:

a first reservoir for heated liquid forming a portion of said second duct means;

heating means for liquid in said reservoir;

said second heat exchanger having a fluid-conducting portion in heat exchange relation with said liquid conducting portion of the second heat exchanger, and provided with an outlet port;

temperature sensing means in said port; and temperature controlling means in association therewith controlling said heating means.

7. The apparatus of claim 6 comprising:

a second reservoir for cooled liquid forming a portion of said first duct means.

8. The apparatus of claim 1 wherein:

said second heat exchanger comprises an assembly similar to said assembly of the first heat exchanger and said exothermic liquid-conducting portion is oriented with respect to the inflow means thereof in upward relation with respect to said outflow means.

9. The apparatus of claim 3 comprising:

a pump and a proportioning valve positioned in the order named in said second duct means downstream from said first or heated liquid reservoir, said proportioning valve being ported to variably divide its discharge between a downstream portion of said first duct means and a return line to said first reservoir, said proportioning means being connected to and controllable by said temperature sensing means to return heated water to said first reservoir as the temperature rises in said port.

10. The apparatus of claim 8 comprising:

a pump in the first duct means;

level control means for maintaining liquid at a predetermined level in said second reservoir comprising level responsive means in the second reservoir and valve means located in said first duct means downstream from said pump, said valve means responsively connected with said level responsive means to restrict flow through the first duct means necessary to maintain a minimum liquid level therein.

11. Freeze-resistant heat-recovery apparatus comprising:

an aqueous medium;

a plurality of gas-to-liquid, waste-heat reclaiming, heat exchangers, each having an endothermic liquid-conducting portion providing an upper inflow means and a lower outflow means;

liquid-to-fluid heat-distributing heat exchanger means in remote relation with said plurality of heat exchangers comprising at least one heat exchanger having an exothermic liquid-conducting portion provided with an inflow means and an outflow means;

said liquid-conducting portions of each of said plurality of heat exchangers comprising:

an assembly of vertically-extending horizontally-spaced generally-rectangular sheets arranged in generally parallel planes of which each is indented or embossed substantially over its entire area to provide concavo-convex non-planate portions in said sheets in assembled closely-spaced relationship for causing any fluid passing therebetween to be subjected to turbulence;

said sheets having lateral side edges at opposite lateral extremities, and top and bottom edges;

said sheets being joined together in horizontally successive pairs of which each pair of sheets has its top edges joined and its bottom edges joined to provide a horizontal passageway; the side edges of adjacent mutually-facing sheets of adjacent pairs and tops-and-bottom joined sheets being joined at opposite lateral extremities to provide a vertical passageway between each two adjacent pairs of top-and-bottom joined sheets;

closure means at four corners of the assembly connecting with the sheets to close off inner communication of the vertical passageways with the horizontal passageways; said inflow means of the plurality of heat exchangers; comprising shower means supported over the upper entrances of all of said vertical passageways;

liquid supply means and regulating means therefor limiting the supply of said liquid to said shower means to a rate avoiding a standing liquid head in said vertical passageways;

header means for enclosing the entrances of said horizontal passageways at one side of said assembly; means for supplying air or other gas to said header means;

reservoir means for heated liquids;

first duct means connecting the outflow means of said plurality of exchangers with the reservoir means;

second duct means connecting the reservoir means with the inflow means of said heat exchanger means;

liquid conducting means connecting said outflow means of the heat exchanger means with said inflow means of said plurality of exchangers;

heating means in the reservoir;

said heat exchanger means having a fluid-conducting portion in heat exchanger relation with said liquid-conducting portion of the heat exchanger means and being provided with an outlet port;

temperature sensing means in said port, and temperature controlling means in association therewith controlling said heating means.

12. The apparatus of claim 11 wherein:

the sheets of said liquid-conducting portions are corrugated and the direction of sinuosity of corrugation of the sheets of each of said liquid-conducting portions extend in a common direction; and said inflow means of each liquid-conducting portion is in substantially vertically upward relation with its corresponding outflow means.

* * * * *